US011834804B1

(12) United States Patent
Malloy

(10) Patent No.: US 11,834,804 B1
(45) Date of Patent: Dec. 5, 2023

(54) RETAINER PLATE AND RETENTION PIN FOR TRENCH SHORING SECUREMENT

(71) Applicant: Tom Malloy Corporation, Compton, CA (US)

(72) Inventor: Thomas Malloy, Villa Park, CA (US)

(73) Assignee: Tom Malloy Corporation, Compton, CA (US)

( * ) Notice: Subject to any disclaimer, the term of this patent is extended or adjusted under 35 U.S.C. 154(b) by 0 days.

(21) Appl. No.: 17/929,266

(22) Filed: Sep. 1, 2022

(51) Int. Cl.
*E02D 17/08* (2006.01)

(52) U.S. Cl.
CPC ..... *E02D 17/083* (2013.01)

(58) Field of Classification Search
CPC ..... E02D 17/083; E02D 17/08; E02D 17/04; E04G 25/061; E04G 2017/008
See application file for complete search history.

(56) References Cited

U.S. PATENT DOCUMENTS

| | | | | |
|---|---|---|---|---|
| 3,632,075 | A * | 1/1972 | Munoz | E04G 25/06 248/354.5 |
| 3,750,410 | A * | 8/1973 | Converse | E02D 17/08 405/272 |
| 4,033,138 | A | 7/1977 | Griswold | |
| 4,095,387 | A * | 6/1978 | Loewe | E04G 25/068 52/645 |
| 4,685,837 | A * | 8/1987 | Cicanese | E02D 17/08 405/282 |
| 4,752,057 | A * | 6/1988 | Hagemes | E04G 25/063 248/354.3 |
| 4,752,157 | A * | 6/1988 | Ischebeck | E02D 17/08 405/282 |
| 5,839,707 | A * | 11/1998 | Barringer | E02D 17/08 248/214 |
| 5,902,075 | A * | 5/1999 | Krings | E02D 17/08 405/251 |
| 7,661,908 | B1 | 2/2010 | Kundel, Sr. | |
| 7,972,085 | B2 | 7/2011 | Hess | |
| RE46,619 | E | 12/2017 | Chilton | |
| 11,021,847 | B2 | 6/2021 | Burleson | |
| 2005/0141970 | A1* | 6/2005 | Glamuzina | E02D 17/083 405/274 |
| 2006/0002768 | A1* | 1/2006 | Meyer | E02D 17/04 405/272 |

FOREIGN PATENT DOCUMENTS

| | | |
|---|---|---|
| CZ | 291711 | 3/2003 |
| DE | 102006019236 | 11/2007 |
| DE | 102015109106 | 12/2016 |
| EP | 2261424 | 12/2010 |
| EP | 2369061 | 6/2013 |
| WO | 1996008609 | 3/1996 |

* cited by examiner

*Primary Examiner* — Benjamin F Fiorello
(74) *Attorney, Agent, or Firm* — Kevin Schraven; Anooj Patel; Hankin Patent Law, APC

(57) ABSTRACT

A trench shield securement device, comprising: a retention pin; and a retainer plate; wherein the retainer plate comprises an opening that is configured to surround and engage a trench shield top box pipe socket and a trench shield base box pipe socket that have been aligned and stacked; and wherein, after the retainer plate is engaged with said aligned and stacked pipe sockets, the retention pin is configured to be inserted into a center opening of the top box pipe socket and into a center opening of the base box pipe socket, such that said retainer plate is held substantially in place.

20 Claims, 7 Drawing Sheets

RETAINER PLATE AND RETENTION PIN FOR TRENCH SHORING SECUREMENT

FIELD OF THE DISCLOSURE

The present disclosure relates to trench shield securement. More specifically, the present disclosure relates to a trench shield securement device for stackable trench shields. Utilizing a retainer plate and retention pin allows the user to stabilize stacked trench shields quickly and securely without the need for extra equipment.

BACKGROUND

Trench shields are relatively large metal (typically steel or aluminum) structures used to protect workers that are performing tasks in a trench. Specifically, a trench shield prevents cave ins on utility workers in trenches. Typically, a trench shield has sidewalls that are held apart by steel or aluminum spreaders. The spreaders may be interchangeable to match the width of the trench. Trench shields are used in various applications, commonly for installing underground utilities. For deeper installations operators utilize stackable trench shields. Securing the upper trench shield to the lower trench shield, top box and base box respectively, is crucial so that the two structures do not collapse or shift with respect to each other during excavation. Existing securement solutions require large pre-welded stacking buckets or fast-stack-brackets which must be installed between the top and base box.

Other modes of securement have required securing the top and base boxes with nuts and bolts. The bolts are inserted into pipe sockets at each corner of the shield. The bolts are secured by screwing a nut at the bottom of the bolt. Installing current securements requires significant time, steps, tools, and equipment. Large stacking pockets can be cumbersome in the tight confines of the trenches, where fast-stack-brackets might require craning to position them into place. Securing top and base boxes with nuts and bolts requires wrenches and, in some cases, may require two people for assembly. Additionally, with a nut and bolt system, all lateral forces are placed on the bolt alone which could bend or shear the bolt.

Thus, what is needed is a trench shield securement device that allows operators to rapidly secure the top and base boxes without the need for additional tools, time, manpower, or craning; and that also provides more lateral support than nuts and bolts

SUMMARY

The following presents a simplified overview of the example embodiments in order to provide a basic understanding of some embodiments of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented herein below. It is to be understood that both the following general description and the following detailed description are exemplary and explanatory only and are not restrictive.

One embodiment may be a retainer plate that is configured to matingly frame two stacked pipe sockets, which themselves are configured to engage with a retention pin.

The retainer plate may have one, two, or more handles for making it easier to lift and position into place. In other embodiments, there is no handle. In other embodiments, the handle/s is/are grooves, notches, and/or cutouts in the retainer plate. In addition to handling the retainer plate with their hands, the workers may use tools that are specifically designed to interact with the projecting handles or the notch handles.

The retainer plate may have an opening that is configured to be larger than length and width of two stacked pipe sockets that are attached to two stacked trenching shields. Typically, the opening will fit relatively snuggly with the two stacked pipe sockets, such that the stacked trenching shields are firmly held in place.

One embodiment may be a trench shield securement device, comprising a retention pin; a retainer plate; a top box pipe socket; and a base box pipe socket; wherein the retainer plate is placed over the top box pipe socket and the base box pipe socket; wherein the retention pin attaches the retainer plate to the top box pipe socket and the base box pipe socket. The trench shield securement device where the said retainer plate has two handles. The trench shield securement device wherein the retention pin comprises of a tampered portion, dividing lip, and a handle. Typically, the securement system is installed on both sides of the trench shield.

Another embodiment may be a trench shield securement device, comprising: a retention pin; and a retainer plate; wherein the retainer plate comprises an opening that is configured to surround and engage a trench shield top box pipe socket and a trench shield base box pipe socket that have been aligned and stacked; and wherein, after the retainer plate is engaged with the aligned and stacked pipe sockets, the retention pin is configured to be inserted into a center opening of the top box pipe socket and into a center opening of the base box pipe socket, such that the retainer plate is held substantially in place. The retainer plate may have one or more handles, which may be two handles as preferred. The two handles are substantially parallel to each other and may be positioned on either side of the opening. The retainer plate may be made of metal, such as steel. When the retainer plate is engaged with the aligned and stacked pipe sockets, the retainer plate may be substantially flush with the trench shield top box and the trench shield bottom box, such that the boxes and retainer plate may be parallel to each other and touching. The retention pin may comprise a dividing lip and a shaft. The dividing lip of the retention pin preferably may have a diameter that may be greater than a diameter of the center opening of the top box pipe socket and that may be greater than a diameter of the center opening of the base box pipe socket. Conversely, the shaft of the retention pin may have a diameter that is less than the diameter of the center opening of the top box pipe socket and that is less than the diameter of the center opening of the base box pipe socket. The shaft may be configured to have a length that at least as long as a combined length of the two pipe sockets, such that it extends the length of both pipe sockets. The retention pin may further comprise a handle and a tapered end. The retention pin may be metal, such as steel.

Another embodiment may be a trench shield securement device, comprising: a retention pin; and a retainer plate; wherein the retainer plate comprises an opening that is configured to surround and engage a trench shield top box pipe socket and a trench shield base box pipe socket that have been aligned and stacked; wherein, after the retainer plate is engaged with the aligned and stacked pipe sockets, the retention pin is configured to be inserted into a center opening of the top box pipe socket and into a center opening of the base box pipe socket, such that the retainer plate is held substantially in place; wherein the retainer plate comprises two handles; wherein when the retainer plate is engaged with the aligned and stacked pipe sockets, the retainer plate is substantially flush with the trench shield top box and the trench shield bottom box; and wherein the retention pin comprises a dividing lip, a shaft, and a handle. The two handles may be substantially parallel to each other and may be positioned on either side of the opening. The dividing lip of the retention pin may have a diameter that is greater than a diameter of the center opening of the top box pipe socket and that is greater than a diameter of the center opening of the base box pipe socket. The shaft of the retention pin may have a diameter that is less than the diameter of the center opening of the top box pipe socket and that may be less than the diameter of the center opening of the base box pipe socket. The shaft may be configured to have a length that at least as long as a combined length of the two pipe sockets.

Still other advantages, embodiments, and features of the subject disclosure will become readily apparent to those of ordinary skill in the art from the following description wherein there is shown and described a preferred embodiment of the present disclosure, simply by way of illustration of one of the best modes best suited to carry out the subject disclosure. As it will be realized, the present disclosure is capable of other different embodiments and its several details are capable of modifications in various obvious embodiments all without departing from, or limiting, the scope herein. Accordingly, the drawings and descriptions will be regarded as illustrative in nature and not as restrictive.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE ILLUSTRATIVE EMBODIMENTS

Figure 1:
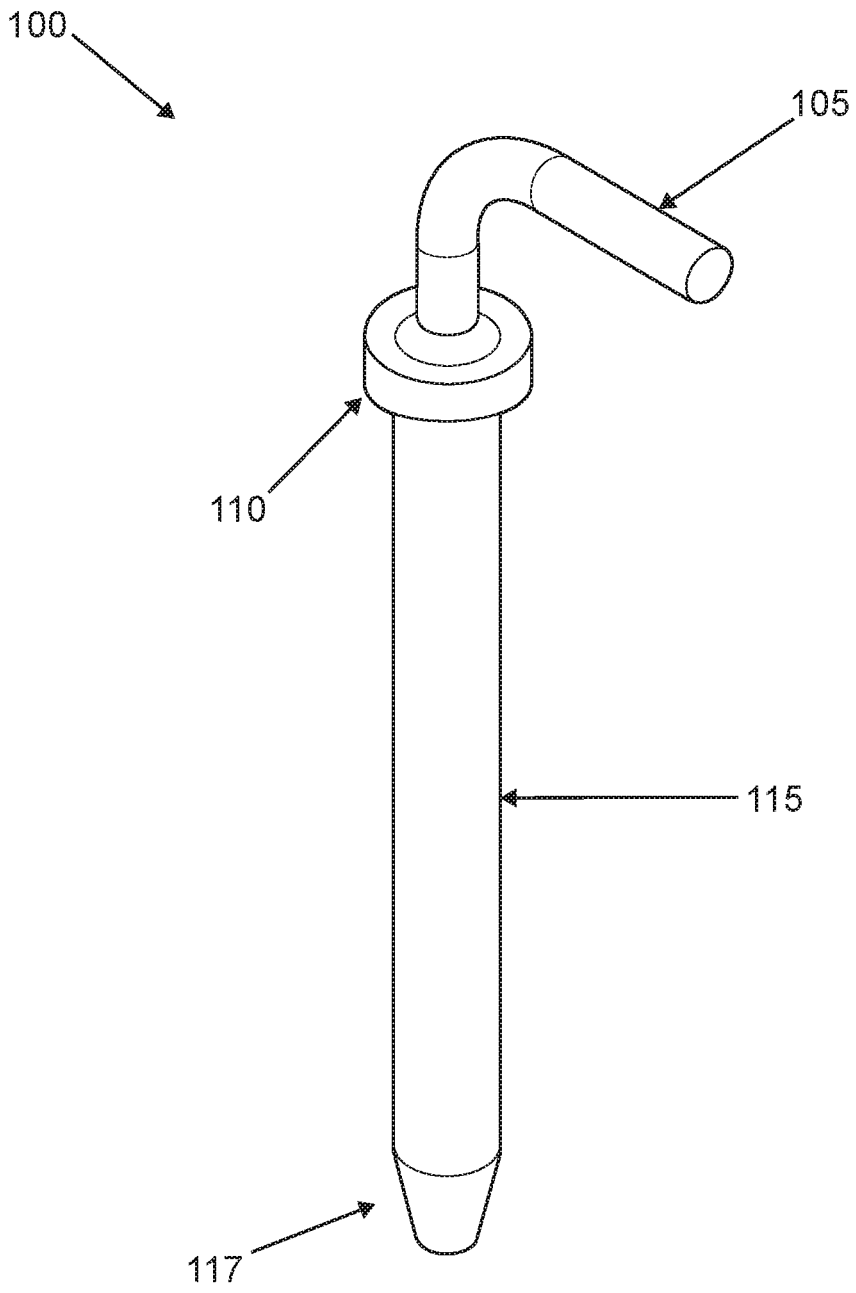
FIG. 1 is an illustration of a perspective view of one embodiment of a retention pin.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that may be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all embodiments of this application including, but not limited to, steps in disclosed methods. Thus, if there are a variety of additional steps that may be performed it is understood that each of these additional steps may be performed with any specific embodiment or combination of embodiments of the disclosed methods.

The present methods and systems may be understood more readily by reference to the following detailed description of preferred embodiments and the examples included therein and to the Figures and their previous and following description.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 5% of the indicated number or range of numbers. In one embodiment, the term "approximately" and "about", may refer to a deviance of between 0.001-40% from the indicated number or range of numbers.

Various embodiments are now described with reference to the drawings. In the following description, for purposes of explanation, numerous specific details are set forth in order to provide a thorough understanding of one or more embodiments. It may be evident, however, that the various embodiments may be practiced without these specific details. In other instances, well-known structures and devices are shown in block diagram form to facilitate describing these embodiments.

One embodiment may be a retainer plate and retention pin, configured to engage with a top box pipe socket and a base box pipe socket to secure the retainer plate around both pipe sockets to provide stability to the stacked trench shields.

FIG. 1 is an illustration of a perspective view of one embodiment of a retention pin. FIG. 1 is an illustration of one embodiment of the retention pin 100 which may comprise of a handle 105, a dividing lip 110, shaft 115, and a tapered end 117. As shown, the dividing lip 110 preferably separates the handle 105 from the shaft 115. The shaft 115 is preferably configured to be long enough to entirely pass through two adjoining pipe sockets of two stacked trench shields. The shaft 115 is preferably wide or thick enough to have the strength to keep the two stacked trench shields from shifting with respect to each other. The retention pin 100 may be made from any strong and sturdy material, such as metal, wood, plastic, or composite, but it preferably is made from a very strong metal such as tungsten, steel, iron, chromium, titanium, and the like.

The shaft 115 may have a width of 0.5 inches to 6 inches, and more preferably about 1.2 to 1.5 inches. The shaft may a typical length in the range of 5 inches to 30 inches, and more preferably about 11 to 13 inches.

The shaft 115 may taper downward and may have a tapered (or conical) end 117 that allows for easier insertion into the pipe sockets of the trench shields.

The proximal end of the shaft 115 may preferably have a dividing lip 110, which is wider than the shaft 115 and is preferably configured to be wider than the pipe socket of the trench shields with which it is used. On the other side of the dividing lip 110 the retention pin 100 may have a handle 105. Although the handle 105 shown in FIG. 1 is bent, the handle 105 may be of any shape that allows a user to engage and disengage the retention pin 100 with the pipe sockets of trench shields.

In some embodiments the retention pin 100 may be constructed from several parts that are connected, such as via welding, together, or it may be a single unitary piece that is molded, forged, or stamped. Because the pin is supplemented by the retainer plate, shown in FIG. 2, it does not have to be overly thick.

Figure 2:
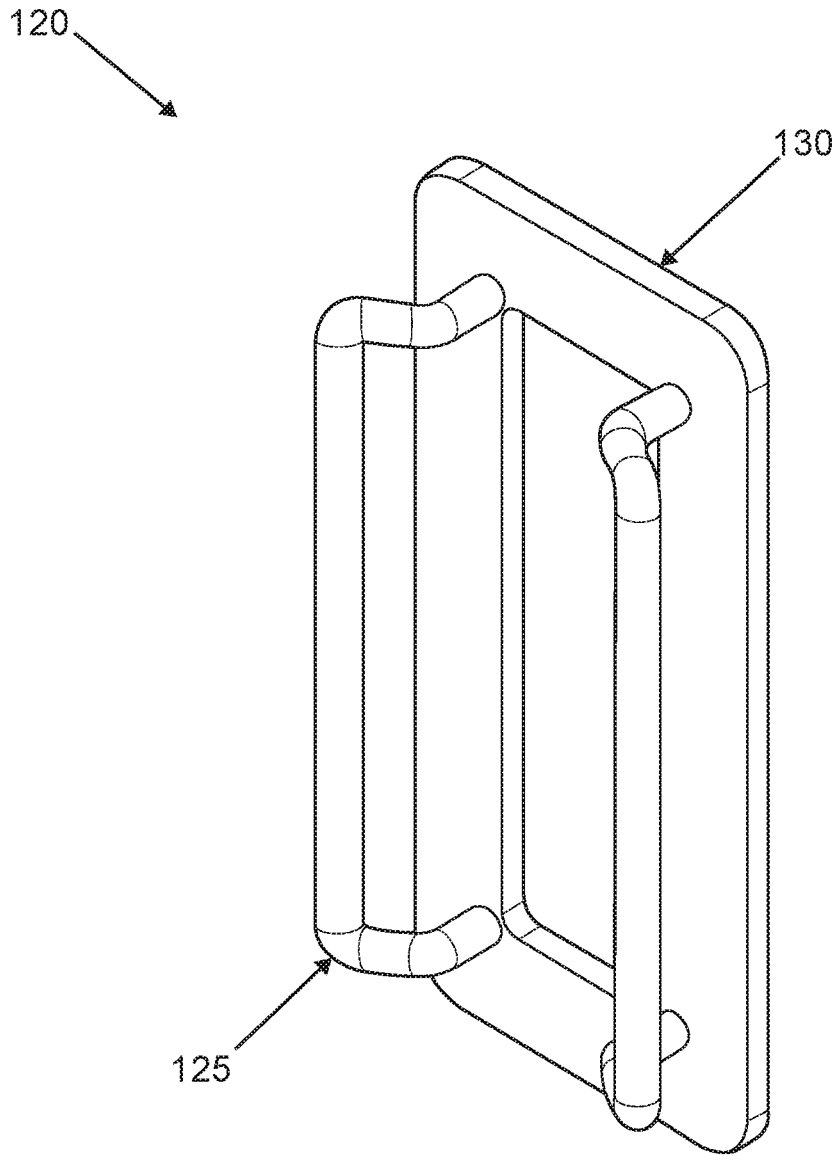
FIG. 2 is an illustration of a perspective view of one embodiment of the retainer plate with handles.

FIG. 2 is an illustration of a perspective view of one embodiment of the retainer plate with handles. FIG. 2 is an illustration of one embodiment of the retainer plate 120 with two handles 125 attached to the rectangular ring 130. The retainer plate 120 may be any strong material but may preferably comprise American Society of Testing and Materials (ASTM) A572 grade 50 steel with approximately 50 ksi (kilopounds per square inch) yield strength. The thickness of the rectangular ring 130 may vary but may preferably be from 0.3 inches to 3.0 inches. The thicker the stronger, but the thinner the lighter. Care should be taken in selecting a thickness that is liftable, but still strong enough to hold the two trench shields securing together. As shown, the retainer plate 120 may preferably be a rectangular plate whose center portion is removed, creating a rectangular ring 130 with each side ranging from 1-12 inches wide.

The opening in the ring 130 is preferably sized so as to matingly engage with and frame two stacked pipe sockets of two stacked trench shields. In one embodiment, the retainer plate 120 may be approximately 3 to 24 inches wide and 6 to 36 inches tall, and more preferably may be approximately 5.75 inches wide and approximately 18 inches tall. The inner width of the opening in the ring 130 may preferably be 1 to 20 inches wide, and more preferably may be 2.75 inches wide. The inner height of the opening in the ring 130 may preferably be 3 to 30 inches tall, and more preferably may be 12 inches tall.

As shown, the handles 125 may be attached to the front of the retainer plate 120. The handles 125 may be any shape, but are shown, as preferred, as being cylindrical. The diameter of the handles may range between 0.05 inches to 2.75 inches. As shown, each handle 125 may be attached, such as by welding, to the rectangular ring 130 such that a user may more easily maneuver the plate to engage with two stacked pipe sockets. The handles 125 may be angled outwards from the centerline of the retainer plate 120 such that the bent portions form a 90°-179° angle between the bent portion and the portion that is substantially perpendicular to the retainer plate 120. The handles 125 may be bent in such a manner that the total distance from one bent portion of one handle 125 to the other bent portion of the other handle may be the same width as the rectangular ring 130. Although two handles 125 are shown, there may be one handle, or more than two handles. The handles 125 may be positioned and shaped as shown in FIG. 2 but may also be placed or shaped in any configuration on the front, top, sides, or bottom of the retainer plate 120.

Figure 3:
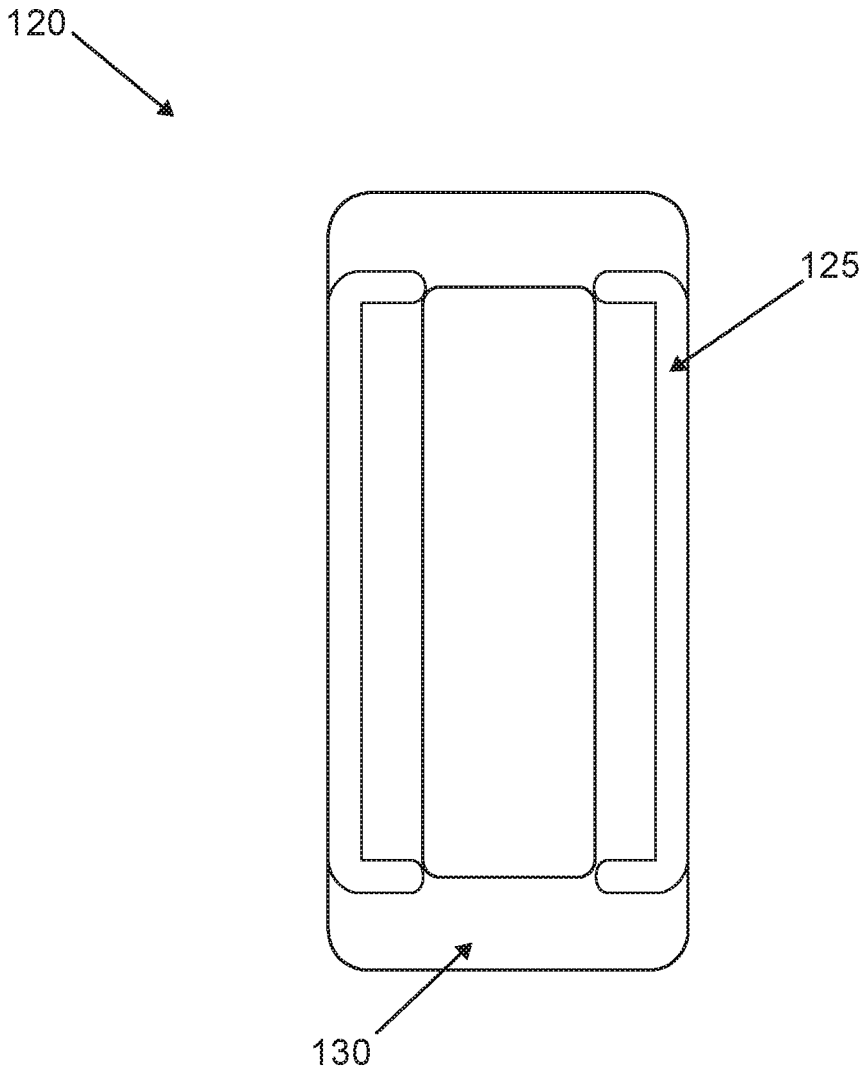
FIG. 3 is an illustration of a front view of one embodiment of the retainer plate with handles.

FIG. 3 is an illustration of a front view of one embodiment of the retainer plate with handles. FIG. 3 is an illustration of one embodiment of the retainer plate 120 with two handles 125 showing that the handles may preferably be placed in such a manner that the handles extend to the edge of the rectangular ring 130.

Figure 4:
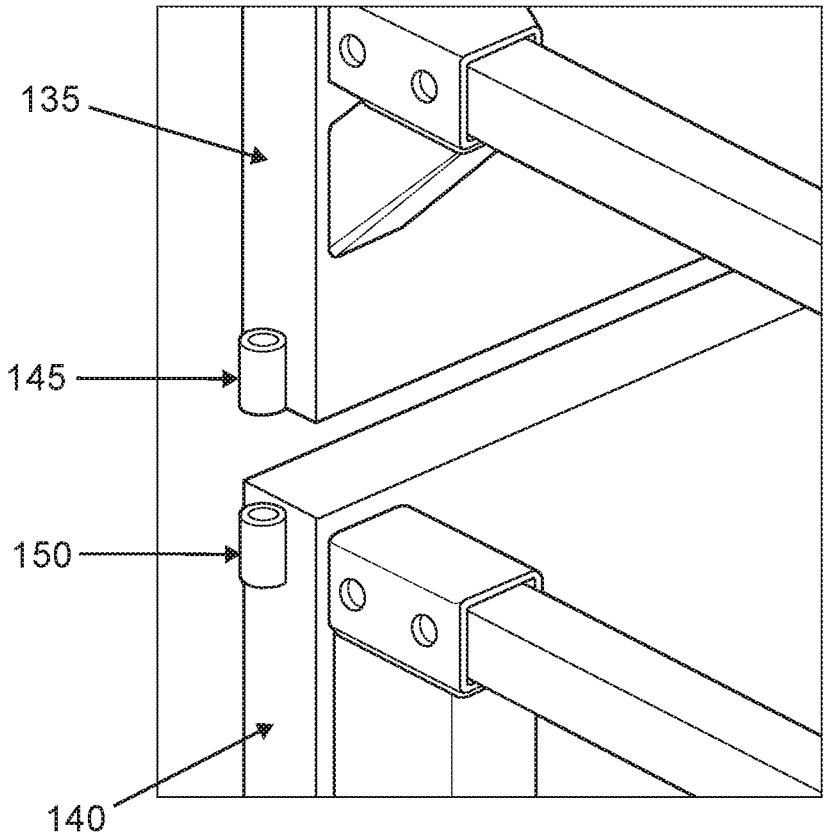
FIG. 4 is an illustration of a top box trench shield and a base box trench shield with pipe sockets about to be stacked.

FIG. 4 is an illustration of a top box trench shield and a base box trench shield with pipe sockets about to be stacked. FIG. 4 is an illustration of one embodiment of a top box 135 and base box 140 equipped with top box pipe socket 145, and base box pipe socket 150. Pipe Sockets 145, 150 may be made from any material, but may preferentially be made from ASTM A53 Grade B steel pipe with a 35 ksi (kilopounds per square inch) yield strength. Pipe sockets 145, 150 may be welded onto the top box 135 and base box 140 in such a manner that when the trenches are stacked, the top box pipe socket 145 and base box pipe socket 150 vertically align. Alignment and length of piping may be preferably sized so that the alignment of the pipe sockets allows the retainer plate 120 to be slid over the vertically pipe sockets 145, 150 so that there is minimal movement allowed for the pipe sockets within the inner cutout of the retainer plate 120. With the plate 120 slid over the pipe sockets 145, 150, the retention pin 100 may be slid into the pipe sockets 145, 150 securing the retainer plate 120 and pipe sockets 145, 150 together to form a very strong stacked trench shield securement device. The diameter of the pipe sockets may preferably be greater than the diameter of the retention pin 100 shaft 115, but less than the diameter of the dividing lip 110.

Figure 5:
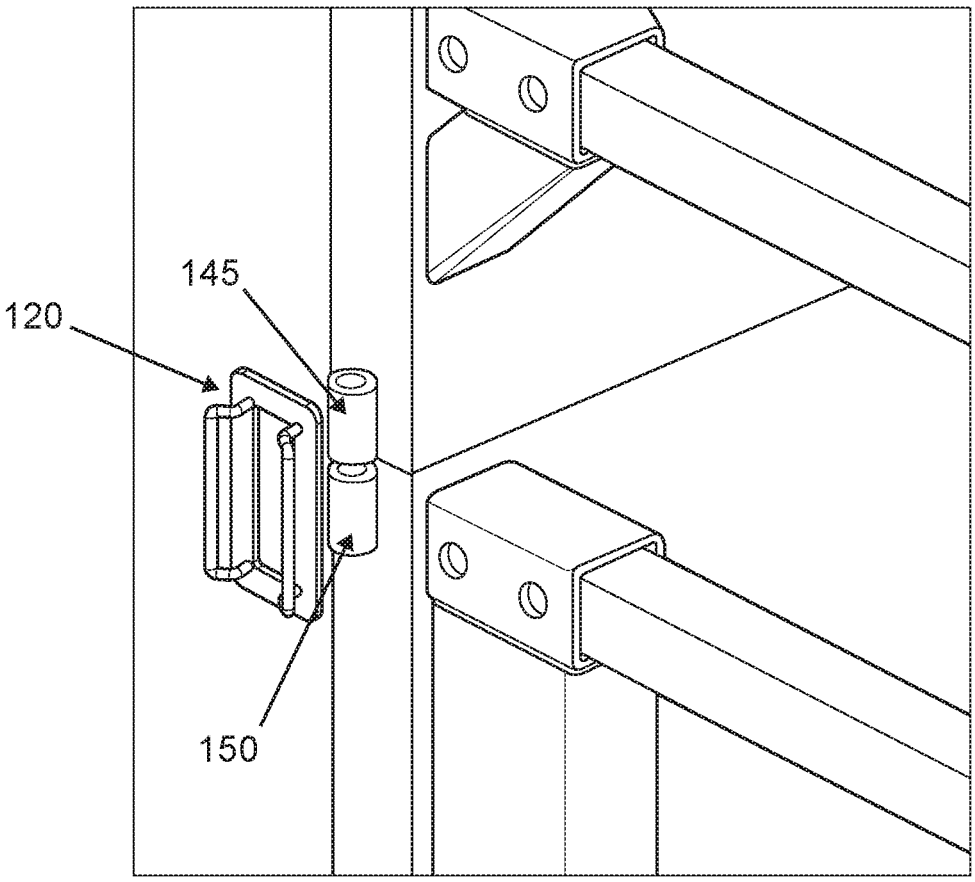
FIG. 5 is an illustration of a stacked top box trench shield and a base box trench shield with a retainer plate that is about to engage the two stacked pipe sockets.

FIG. 5 is an illustration of a stacked top box trench shield and a base box trench shield with a retainer plate that is about to engage the two stacked pipe sockets. FIG. 5 shows the top box pipe socket 145 aligned with the base box pipe socket 150. Retainer plate 120 has been positioned so that it is about to engage the stacked and alighted pipe sockets 145, 150.

Figure 6:
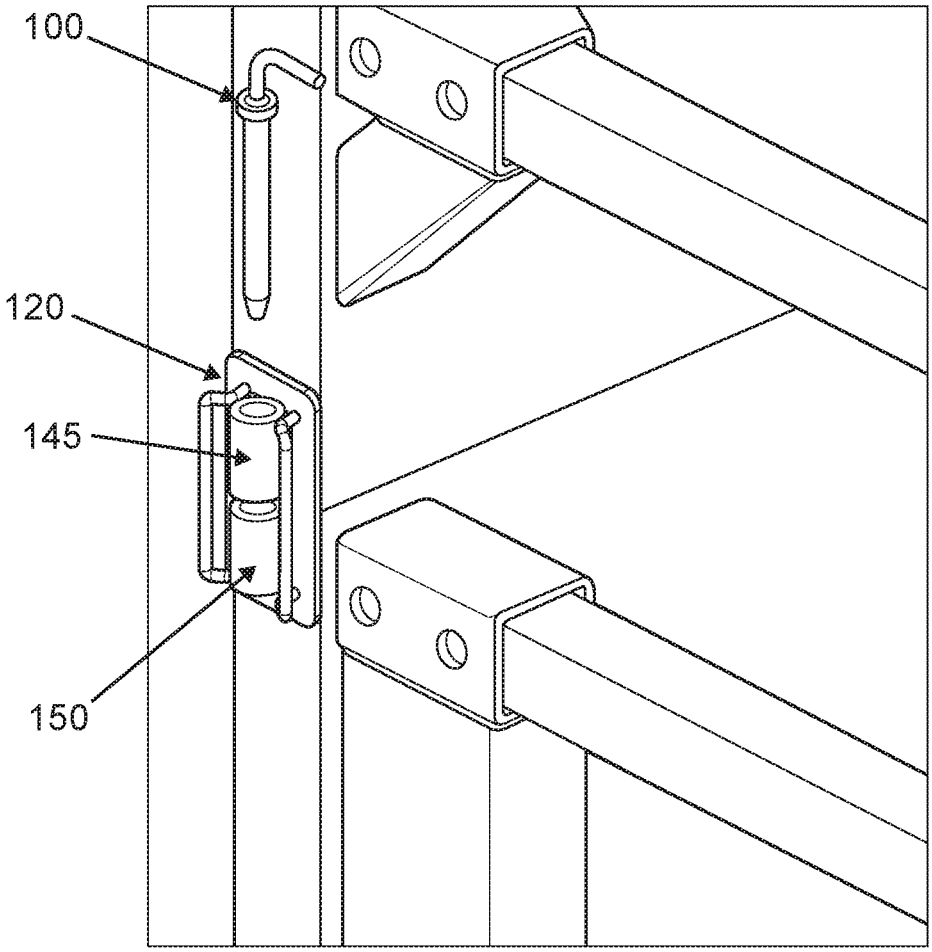
FIG. 6 is an illustration of a stacked top box trench shield and a base box trench shield with the retainer plate substantially in place and a retention pin that is about to engage the two stacked pipe sockets.

FIG. 6 is an illustration of a stacked top box trench shield and a base box trench shield with the retainer plate substantially in place and a retention pin that is about to engage the two stacked pipe sockets. FIG. 6 shows a top box pipe socket 145 aligned with the base box pipe socket 150 with a retainer plate 120 engaged with the two pipe sockets 145, 150. The retention pin 100 is positioned so that it is about to engage with the two pipe sockets 145, 150.

Figure 7:
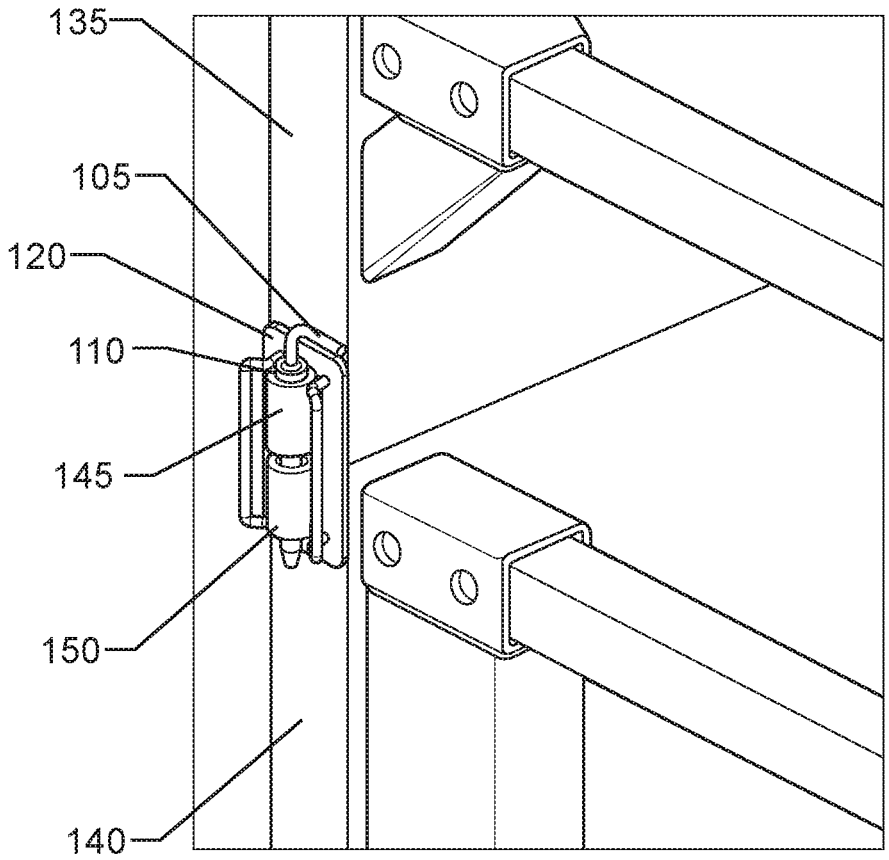
FIG. 7 is an illustration of a stacked top box trench shield and a base box trench shield with the retainer plate substantially in place and a retention pin engaged with the two stacked pipe sockets.

FIG. 7 is an illustration of a stacked top box trench shield and a base box trench shield with the retainer plate substantially in place and a retention pin engaged with the two stacked pipe sockets. As shown in FIG. 7, two trench shields 135, 140 have been stacked and secured together by the retainer plate 120 and retention pin 100 of the present disclosure. The retainer plate 120 is framingly engaged with the two pipe sockets 145, 150, such that they are substantially held substantially in place with respect to each other vertically and horizontally. The retention pin 100 has been fitted into the holes of both pipe sockets 145, 150, such that the two pipe sockets 145, 150 are held substantially in place horizontally and in a front to back manner. FIG. 7 shows that the shaft of the retention pin 100 runs the entire height of both stacked pipe sockets 145, 150, and that the collar, or dividing lip 110, rests on top of pipe socket 145, with the weight of the retention pin 100 keeping it substantially in place. Although not shown, the retention pin 100 may be further locked into place such that it cannot accidentally be removed by pulling upward on the handle 105. The dividing lip 110 is shown as cylindrical and may provide further support for securing the two trench shields 135, 140 together. In some embodiments, the dividing lip may have a flat side that is configured to matingly engage with the front of the retainer plate 120, such that the pin is prevented from swiveling freely and further securing the two trench shields 135, 140 together. When the user wants to separate the two trench shields 135, 140, they start by pulling up on retention pin 100, then pulling off the retainer plate 120. The handles on the pin and retainer plate are not necessary, but they make handling the securing device much easier.

Various embodiments presented in terms of systems may comprise a number of components, modules, and the like. It is to be understood and appreciated that the various systems may include additional components, modules, etc. and/or may not include all of the components, modules, etc. discussed in connection with the figures. A combination of these approaches may also be used.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

It will be apparent to those of ordinary skill in the art that various modifications and variations may be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A trench shield securement device, comprising:

a retention pin; and a retainer plate;

wherein said retainer plate comprises an opening that is configured to surround and engage a trench shield top box pipe socket and a trench shield base box pipe socket that have been aligned and stacked; and wherein, after said retainer plate is engaged with said aligned and stacked pipe sockets, said retention pin is configured to be inserted into a center opening of said top box pipe socket and into a center opening of said base box pipe socket, such that said retainer plate is held substantially in place.

2. The trench shield securement device of claim 1, wherein said retainer plate comprises one or more handles.

3. The trench shield securement device of claim 2, wherein there are two handles.

4. The trench shield securement device of claim 3, wherein said two handles are substantially parallel to each other and are positioned on either side of the opening.

5. The trench shield securement device of claim 1, wherein said retainer plate is made of metal.

6. The trench shield securement device of claim 5, wherein said retainer plate is made of steel.

7. The trench shield securement device of claim 1, wherein when said retainer plate is engaged with said aligned and stacked pipe sockets, said retainer plate is substantially flush with said trench shield top box and said trench shield bottom box.

8. The trench shield securement device of claim 1, wherein said retention pin comprises a dividing lip and a shaft.

9. The trench shield securement device of claim 8, wherein said dividing lip of said retention pin has a diameter that is greater than a diameter of said center opening of said top box pipe socket and that is greater than a diameter of said center opening of said base box pipe socket.

10. The trench shield securement device of claim 8, wherein said shaft of said retention pin has a diameter that is less than said diameter of said center opening of said top box pipe socket and that is less than said diameter of said center opening of said base box pipe socket.

11. The trench shield securement device of claim 8, wherein said shaft is configured to have a length that at least as long as a combined length of said two pipe sockets.

12. The trench shield securement device of claim 8, wherein said retention pin further comprises a handle.

13. The trench shield securement device of claim 8, wherein said retention pin further comprises a tapered end.

14. The trench shield securement device of claim 8, wherein said retention pin is metal.

15. The trench shield securement device of claim 14, wherein said retention pin is steel.

16. A trench shield securement device, comprising:

a retention pin; and a retainer plate;

wherein said retainer plate comprises an opening that is configured to surround and engage a trench shield top box pipe socket and a trench shield base box pipe socket that have been aligned and stacked;

wherein, after said retainer plate is engaged with said aligned and stacked pipe sockets, said retention pin is configured to be inserted into a center opening of said top box pipe socket and into a center opening of said base box pipe socket, such that said retainer plate is held substantially in place;

wherein said retainer plate comprises two handles;

wherein when said retainer plate is engaged with said aligned and stacked pipe sockets, said retainer plate is substantially flush with said trench shield top box and said trench shield bottom box; and wherein said retention pin comprises a dividing lip, a shaft, and a handle.

17. The trench shield securement device of claim 16, wherein said two handles are substantially parallel to each other and are positioned on either side of the opening.

18. The trench shield securement device of claim 16, wherein said dividing lip of said retention pin has a diameter that is greater than a diameter of said center opening of said top box pipe socket and that is greater than a diameter of said center opening of said base box pipe socket.

19. The trench shield securement device of claim 16, wherein said shaft of said retention pin has a diameter that is less than said diameter of said center opening of said top box pipe socket and that is less than said diameter of said center opening of said base box pipe socket.

20. The trench shield securement device of claim 16, wherein said shaft is configured to have a length that at least as long as a combined length of said two pipe sockets.

* * * * *